US011116286B2

(12) United States Patent
Auyang

(10) Patent No.: US 11,116,286 B2
(45) Date of Patent: Sep. 14, 2021

(54) ARTICLE WITH INTERMEDIATE SIDE LACING SYSTEM AND METHOD OF LACING AN ARTICLE

(71) Applicant: NIKE, Inc., Beaverton, OR (US)

(72) Inventor: Arick Auyang, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 158 days.

(21) Appl. No.: 16/394,598

(22) Filed: Apr. 25, 2019

(65) Prior Publication Data

US 2019/0343231 A1 Nov. 14, 2019

Related U.S. Application Data

(60) Provisional application No. 62/670,226, filed on May 11, 2018.

(51) Int. Cl.
*A43C 1/00* (2006.01)

(52) U.S. Cl.
CPC ..... *A43C 1/003* (2013.01)

(58) Field of Classification Search
CPC .. A43C 1/00; A43C 1/003; A43C 1/06; A43C 11/165
See application file for complete search history.

(56) References Cited

U.S. PATENT DOCUMENTS

| | | | | |
|---|---|---|---|---|
| 216,029 A | | 6/1879 | Durocher | |
| 330,501 A | * | 11/1885 | Mather | A43C 1/04 24/714.7 |
| 395,088 A | * | 12/1888 | Stevens | A43C 5/00 24/713.6 |
| 904,416 A | * | 11/1908 | Washburn | A43C 1/00 24/713.3 |
| 1,005,488 A | | 10/1911 | Vosburgh | |
| 1,043,003 A | | 10/1912 | Faegre | |
| 1,466,078 A | * | 8/1923 | Washburn | A43C 1/00 24/714.9 |
| 1,559,379 A | * | 10/1925 | Rodriguez | A43C 1/00 24/712.4 |
| 1,767,732 A | | 6/1930 | Breadon | |
| 1,885,297 A | | 11/1932 | Santori | |
| 1,995,243 A | * | 3/1935 | Clarke | A43C 1/00 24/713.3 |
| 2,357,980 A | | 9/1944 | Spiro | |
| 3,168,769 A | | 2/1965 | Smith | |
| 3,193,950 A | | 7/1965 | Liou | |
| 3,546,796 A | | 12/1970 | Adams | |
| 3,834,048 A | | 9/1974 | Maurer | |

(Continued)

FOREIGN PATENT DOCUMENTS

| | | | |
|---|---|---|---|
| CN | 201042236 | Y | 4/2008 |
| CN | 101558923 | A | 10/2009 |

(Continued)

*Primary Examiner* — Ted Kavanaugh
(74) *Attorney, Agent, or Firm* — Quinn IP Law

(57) ABSTRACT

An article of footwear comprising a side lacing pattern features laces ending on the same side of the footwear with both lace ends exiting from the side of an intermediate row of the footwear. The lace travels in a single pass between the upper and lower rows of eyelets, beneath the outer surface of the upper such that the lacing uses each eyelet once without overlapping, using right angle turns at each eyelet within the lacing pattern.

17 Claims, 7 Drawing Sheets

(56) References Cited

U.S. PATENT DOCUMENTS

| | | | | |
|---|---|---|---|---|
| 3,934,346 | A | 1/1976 | Sasaki et al. | |
| 4,414,761 | A * | 11/1983 | Mahood | A43C 1/00 24/712 |
| 4,622,763 | A | 11/1986 | Adams | |
| 5,158,428 | A | 10/1992 | Gessner et al. | |
| 5,293,669 | A | 3/1994 | Sampson | |
| 5,384,971 | A | 1/1995 | Ferry | |
| D389,292 | S | 1/1998 | Egelja | |
| 6,513,211 | B1 | 2/2003 | Fisher | |
| 6,938,913 | B2 | 9/2005 | Elkington | |
| 7,036,194 | B2 | 5/2006 | Tricker | |
| 8,418,381 | B2 | 4/2013 | Reagan et al. | |
| 8,448,353 | B2 | 5/2013 | Seliger | |
| 9,192,204 | B1 | 11/2015 | Liles et al. | |
| 2005/0081403 | A1 | 4/2005 | Mathieu | |
| 2007/0130799 | A1* | 6/2007 | Seliger | A43C 1/06 36/50.1 |
| 2008/0168685 | A1 | 7/2008 | Kim et al. | |
| 2008/0216351 | A1 | 9/2008 | Carroll et al. | |
| 2009/0100649 | A1 | 4/2009 | Bar et al. | |
| 2013/0019501 | A1 | 1/2013 | Gerber | |
| 2013/0117976 | A1 | 5/2013 | Harris et al. | |
| 2014/0123449 | A1 | 5/2014 | Soderberg et al. | |
| 2015/0096193 | A1 | 4/2015 | Senegal | |
| 2015/0342302 | A1 | 12/2015 | Hahnenberger et al. | |
| 2017/0105489 | A1* | 4/2017 | Lovett | A43C 1/04 |
| 2017/0202310 | A1 | 7/2017 | Spanks et al. | |
| 2017/0202313 | A1 | 7/2017 | Spanks | |
| 2018/0027926 | A1 | 2/2018 | Tsai | |
| 2019/0343230 | A1 | 11/2019 | Auyang | |
| 2019/0343232 | A1 | 11/2019 | Auyang | |

FOREIGN PATENT DOCUMENTS

| | | | |
|---|---|---|---|
| CN | 202714289 | U | 2/2013 |
| DE | 3920266 | A1 | 1/1991 |

* cited by examiner

ARTICLE WITH INTERMEDIATE SIDE LACING SYSTEM AND METHOD OF LACING AN ARTICLE

CROSS-REFERENCE TO RELATED APPLICATIONS

This application claims the benefit of priority to U.S. Provisional Application No. 62/670,226, filed May 11, 2018 which is incorporated by reference in its entirety.

TECHNICAL FIELD

The present disclosure relates generally to an article having a lacing system, such as an article of footwear, and to a method of lacing an article.

BACKGROUND

Articles of footwear generally include two primary elements: an upper and a sole structure secured to a lower portion of the upper. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
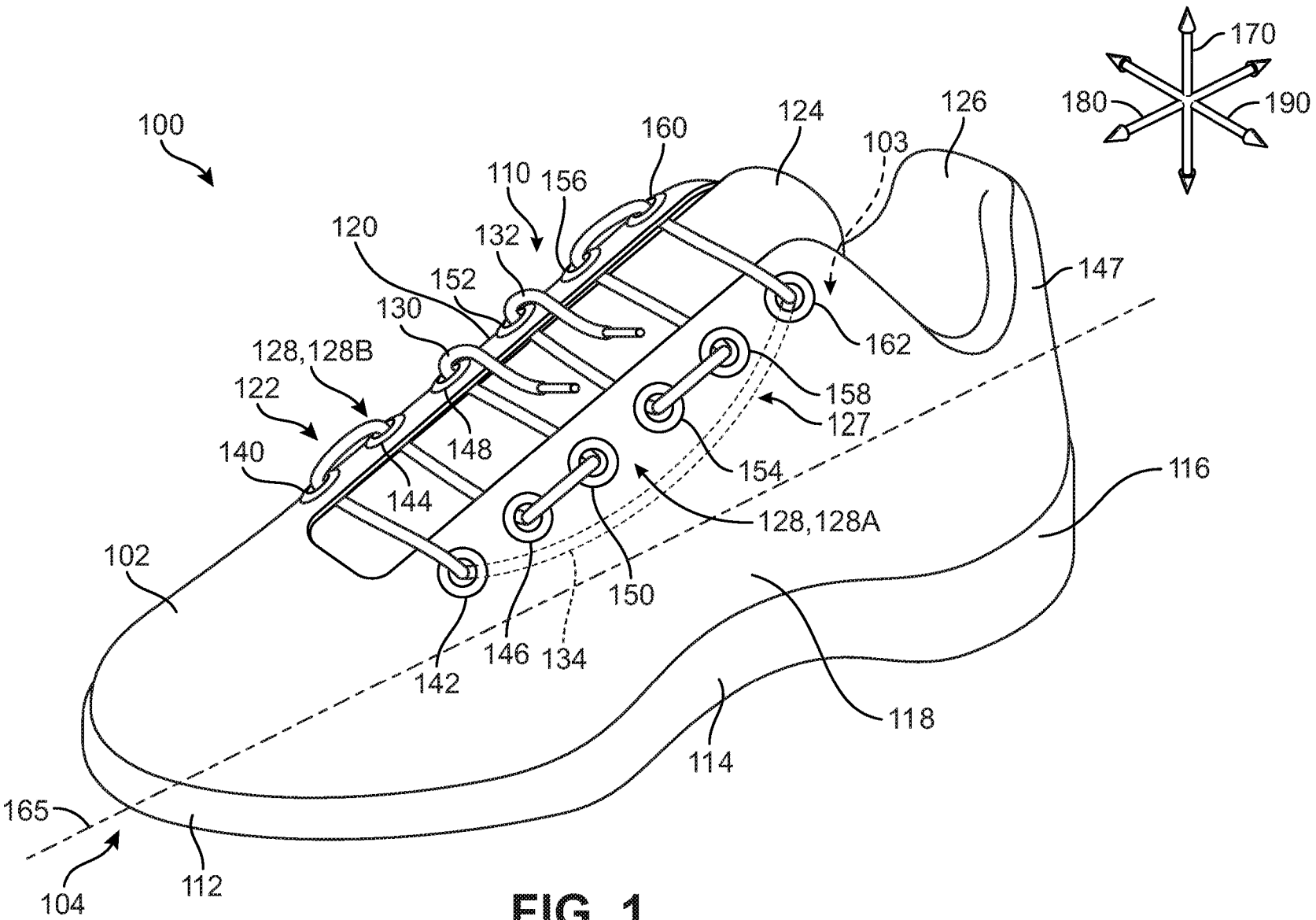
FIG. 1 is a medial isometric view of an embodiment of an article of footwear including a lacing system.

An article, such as but not limited to an article of footwear, may comprise a body having a first portion and a second portion. The article may further comprise a lacing system including a lace and lace-receiving passages arranged in rows on the body. Each of the rows may include a lace-receiving passage on the first portion and a lace-receiving passage on the second portion. The rows may include at least a first end row, a second end row, a first intermediate row, and a second intermediate row. The first intermediate row and second intermediate row may be disposed between the first end row and the second end row and may be adjacent to one another. The lace may extend through each of the lace-receiving passages, a first end of the lace may exit from one of the lace-receiving passages in the first intermediate row, and a second end of the lace may exit from one of the lace-receiving passages in the second intermediate row. The lace may extend directly from one of the lace-receiving passages of the first end row to one of the lace-receiving passages of the second end row on an opposite one of the first portion or the second portion than the lace-receiving passages from which the first end and the second end exit.

In an aspect of the disclosure, the lace may extend through each of the lace-receiving passages only once. This may lessen friction on the lace and the associated force required to tension the lace. In another aspect of the disclosure, the lace may extend under the body where it extends directly from said one of the lace-receiving passages in the first end row to said one of the lace-receiving passages in the second end row. This may lessen wear on this portion of the lace. In another aspect of the disclosure, from each of the lace-receiving passages except the lace-receiving passages from which the first end and the second end exit, the lace extends directly to one of the lace-receiving passages on a same one of the first portion or the second portion and directly to one of the lace-receiving passages in the same row. For example, in such an embodiment, the rows may be parallel such that the lace turns approximately 90 degrees at each of the lace-receiving passages from which the lace extends directly to one of the lace-receiving passages on a same one of the first portion or the second portion and directly to one of the lace-receiving passages in the same row. Such turns may minimize friction and wear on the lace in comparison to a lacing pattern requiring turns of a larger angle. The lace-receiving passages may be but are not limited to eyelets extending through the body from an inner surface of the body to an outer surface of the body.

With the lace routed through the lace-receiving passages in this lacing pattern having the ends of the lace exiting from the middle-most ones of the intermediate rows and the lace extending directly from the top row to the bottom row under the article on an opposite side of the article than where the lace exits, the article is tightened over a greater zone (i.e., at more rows of lace-receiving passages) via a single pull on the ends. The lacing pattern allows approximately 90 degree turns of the lace, and prevents the lace from crisscrossing or overlapping itself. These features help reduce friction encountered by the lace during tightening.

To secure the lace after tensioning the lace, thereby securing the tensioned state of the lace and the body, the first end may be tied to the second end. Alternatively or in addition, the lacing system may include a fastener that secures the first end and the second end of the lace relative to one another.

In one example embodiment, the article is an article of footwear, and the body is an upper of the article of footwear. The body may define an ankle opening, with the second end row nearer the ankle opening than is the first end row.

Within the scope of the present disclosure, an article of footwear comprises an upper having a first portion and a second portion. The article of footwear further comprises a lacing system including a lace and lace-receiving passages arranged in rows on the upper, each row including a lace-receiving passage on the first portion of the upper, and a lace-receiving passage on the second portion of the upper. The rows include at least a top row, a first intermediate row, a second intermediate row, and a bottom row. The first intermediate row and the second intermediate row are disposed between the top row and the bottom row. A first end of the lace exits from one of the lace-receiving passages in the first intermediate row. A second end of the lace exits from one of the lace-receiving passages in the second intermediate row. Each portion of the lace that extends directly between any two of the lace-receiving passages either travels between two of the lace-receiving passages that are in the same row or between two of the lace-receiving passages that are in adjacent ones of the rows and are on a same one of the first portion or the second portion of the upper. The lace extends directly between one of the lace-receiving passages in the top row and one of the lace-receiving passages in the bottom row on a same one of the first portion or the second portion of the upper.

In an aspect of the disclosure, the lace is disposed over the upper where the lace extends directly between two of the lace-receiving passages that are in adjacent ones of the rows. In another aspect of the disclosure, the lace is disposed under the upper where the lace extends directly between two of the lace-receiving passages that are in a same one of the rows. In another aspect of the disclosure, the lace is disposed under the upper where the lace extends directly between two of the lace-receiving passages in non-adjacent ones of the rows. In another aspect of the disclosure, the lace extends through each of the lace-receiving passages only once.

In an example embodiment, from each of the lace-receiving passages except those from which the first end and the second end exit, the lace extends to one of the lace-receiving passages on a same one of the first portion or the second portion and to one of the lace-receiving passages in a same one of the rows.

In an aspect of the disclosure, the first portion is a medial side of the upper, the second portion is a lateral side of the upper, and the medial side and the lateral side are spaced apart by a gap. The lace extends across the gap when extending between lace-receiving passages in a same one of the rows, and the lace travels beneath the upper directly from one of the lace-receiving passages in the top row to one of the lace-receiving passages in the bottom row.

A method of lacing an article is disclosed, the article having a body with a first portion and a second portion, wherein the article includes a lacing system comprising a lace and lace-receiving passages arranged in rows on the body, and wherein the rows comprise at least a top row, a first intermediate row, a second intermediate row, and a bottom row, wherein the first intermediate row and second intermediate row are disposed between the top row and the bottom row. The method comprises routing the lace through each of the lace-receiving passages such that a first end of the lace exits from one of the lace-receiving passage in the first intermediate row, a second end of the lace exits from one of the lace-receiving passage in the second intermediate row, and the lace extends directly from one of the lace-receiving passage in the bottom row to one of the lace-receiving passages in the top row on an opposite one of the first portion or the second portion than the lace-receiving passages from which the first end and the second end exit.

Within the scope of the disclosure, routing the lace includes guiding the lace under the body directly from the lace-receiving passage of the bottom row to the lace-receiving passage of the top row on the opposite one of the first portion or the second portion than the lace-receiving passages from which the first end and the second end exit.

Within the scope of the disclosure, at each of the lace-receiving passages except those from which the first end and the second end exit, routing the lace includes turning the lace such that the lace extends directly to one of the lace-receiving passages on a same one of the first portion or the second portion and directly to one of the lace-receiving passages in a same one of the rows.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

The following discussion and accompanying figures disclose articles of footwear and a method of assembly of an article of footwear. Concepts associated with the footwear disclosed herein may be applied to a variety of athletic footwear types, including but not limited to running shoes, basketball shoes, soccer shoes, baseball shoes, football shoes, and golf shoes, for example, and any of which may be low-top, high-top, or other styles. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal", as used throughout this detailed description and in the claims, refers to a direction extending along a length of a component. For example, a longitudinal direction of an article of footwear extends between a forefoot region and a heel region of the article of footwear. The term "forward" is used to refer to the general direction from the heel region toward the forefoot region, and the term "rearward" is used to refer to the opposite direction, i.e., the direction from the forefoot region toward the heel region.

The term "lateral direction" or "transverse direction", as used throughout this detailed description and in the claims, refers to a side-to-side direction extending along a width of a component. In other words, the lateral direction may extend between a medial side and a lateral side of an article of footwear, with the lateral side of the article of footwear being the surface that faces away from the other foot, and the medial side being the surface that faces toward the other foot.

The term "side", as used in this specification and in the claims, refers to any portion of a component facing generally in a lateral, medial, forward, or rearward direction, as opposed to an upward or downward direction.

The term "vertical", as used throughout this detailed description and in the claims, refers to a direction generally perpendicular to both the lateral and longitudinal directions. For example, in cases where a sole structure is planted flat on a level ground surface, the vertical direction may extend from the ground surface upward. It will be understood that each of these directional adjectives may be applied to individual components of a sole structure. The term "upward" refers to the vertical direction heading away from a ground surface, while the term "downward" refers to the vertical direction heading toward the ground surface. Similarly, the terms "top", "upper", and other similar terms refer to the portion of an object substantially furthest from the ground in a vertical direction, and the terms "bottom", "lower", and other similar terms refer to the portion of an object substantially closest to the ground in a vertical direction.

The "interior" of an article of footwear such as a shoe refers to space that is occupied by a wearer's foot when the shoe is worn. The "inner side" or "inner surface" of a panel or other footwear element refers to the face of that panel or element that is oriented toward the shoe's interior in a completed article of footwear. The "exterior", "outer side" or "outer surface" of an element refers to the face of that element that is oriented away from the shoe's interior in the completed article of footwear. In some cases, the inner side of an element may have other elements between that inner side and the interior in the completed article of footwear. Similarly, an outer side of an element may have other elements between that outer side and the space external to the completed article of footwear. Further, the terms "inward" and "inwardly" shall refer to the direction toward the interior of the article of footwear, and the terms "outward" and "outwardly" shall refer to the direction toward the exterior of the article of footwear. In addition, the term "proximal" refers to a direction that is nearer a center of an article of footwear, or is closer toward a foot when the foot is inserted in the article of footwear as it is worn by a user. Likewise, the term "distal" refers to a relative position that is further away from a center of the article of footwear or footwear component such as an upper. Thus, the terms proximal and distal may be understood to provide generally opposing terms to describe the relative spatial position of a footwear layer.

For purposes of this disclosure, the foregoing directional terms, when used in reference to an article of footwear, shall refer to the article of footwear when sitting in an upright position, with the sole structure facing groundward, that is, as it would be positioned when worn by a wearer standing on a substantially level surface.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The above features and advantages and other features and advantages of the present teachings are readily apparent from the following detailed description of the best modes for carrying out the present teachings when taken in connection with the accompanying drawings.

The drawings disclose an article of footwear 100, also referred to simply as an article, featuring a lacing system 110 with a side lacing pattern. An individual skilled in the relevant art will appreciate, therefore, that the concepts disclosed herein apply to a wide variety of footwear styles, in addition to the specific style discussed in the following material and depicted in the accompanying figures. In the current embodiment, the article of footwear 100 is shown in the form of an athletic shoe, such as a basketball shoe. However, in other embodiments, lacing system 110 may be used with any other kind of footwear including, but not limited to, hiking boots, soccer shoes, football shoes, sneakers, running shoes, cross-training shoes, rugby shoes, baseball shoes as well as other kinds of shoes. The article of footwear 100 as shown is a high-top style. In other embodiments, the article of footwear may be a low-top or other style. Moreover, in some embodiments lacing system 110 may be configured for use with various kinds of non-sports-related footwear, including, but not limited to, slippers, sandals, high-heeled footwear, loafers as well as any other kinds of footwear. As discussed in further detail below, a lacing system may not be limited to footwear, and in other embodiments, a lacing system and/or components associated with a lacing system could be used with various kinds of apparel, including clothing, sportswear, sporting equipment, and other kinds of apparel. In still other embodiments, a lacing system may be used with braces, such as medical braces. In the present disclosure, the term "tensile element", "tension component", "tensioning component", "lacing component", "lacing element", or "lace" means an elongated structure extending continuously between a first end and a second end, capable of routing through lace-receiving passages as described herein, and capable of withstanding a tensile load and includes, but is not limited to, a cable, a strand, a wire, a cord, a thread, or a string, among others. As used herein, an "end" of a lace includes a terminal end of a lace and some portion of the lace at the terminal end, such as for applying a pulling force on the lace, as will be well understood by those skilled in the art.

Additionally, while a single article of footwear is shown in the current embodiments, the same principles taught in this detailed description could be applied to a second, complementary article of footwear that is included with the article of footwear 100 as a pair of footwear.

For purposes of general reference, the article of footwear 100 may be divided into three regions: forefoot region 112, midfoot region 114, and heel region 116. Forefoot region 112 may be generally associated with the toes and joints connecting the metatarsals with the phalanges. Midfoot region 114 may be generally associated with the arch of a foot. Likewise, heel region 116 may be generally associated with the heel of a foot, including the calcaneus bone. In addition, an article of footwear may include medial side 118 and lateral side 120. In particular, medial side 118 and lateral side 120 may be located on either side of a longitudinal midline 165 bisecting the article. The longitudinal midline 165 coincides with a longitudinal axis 180 that extends from forefoot region 112 to heel region 116. Heel region 116 extends upward to an ankle region 147. It will be understood that each of these directional adjectives may also be applied to individual components of an article of footwear, such as an upper 102 and/or a component of a sole structure 104. In addition, a vertical axis 170 refers to the axis perpendicular to a horizontal surface defined by longitudinal axis 180 and lateral axis 190. Furthermore, both medial side 118 and lateral side 120 may extend through forefoot region 112, midfoot region 114, and heel region 116.

It will be understood that forefoot region 112, midfoot region 114, and heel region 116 are only intended for purposes of description and are not intended to demarcate precise regions of an article of footwear. Likewise, medial side 118 and lateral side 120 are intended to represent generally two sides, rather than precisely demarcating an article of footwear into two halves. In addition, forefoot region 112, midfoot region 114, and heel region 116, as well as medial side 118 and lateral side 120, may also be applied to components of an article of footwear, such as a sole structure 104, an upper 102, and/or any other component associated with the article.

Figure 2:
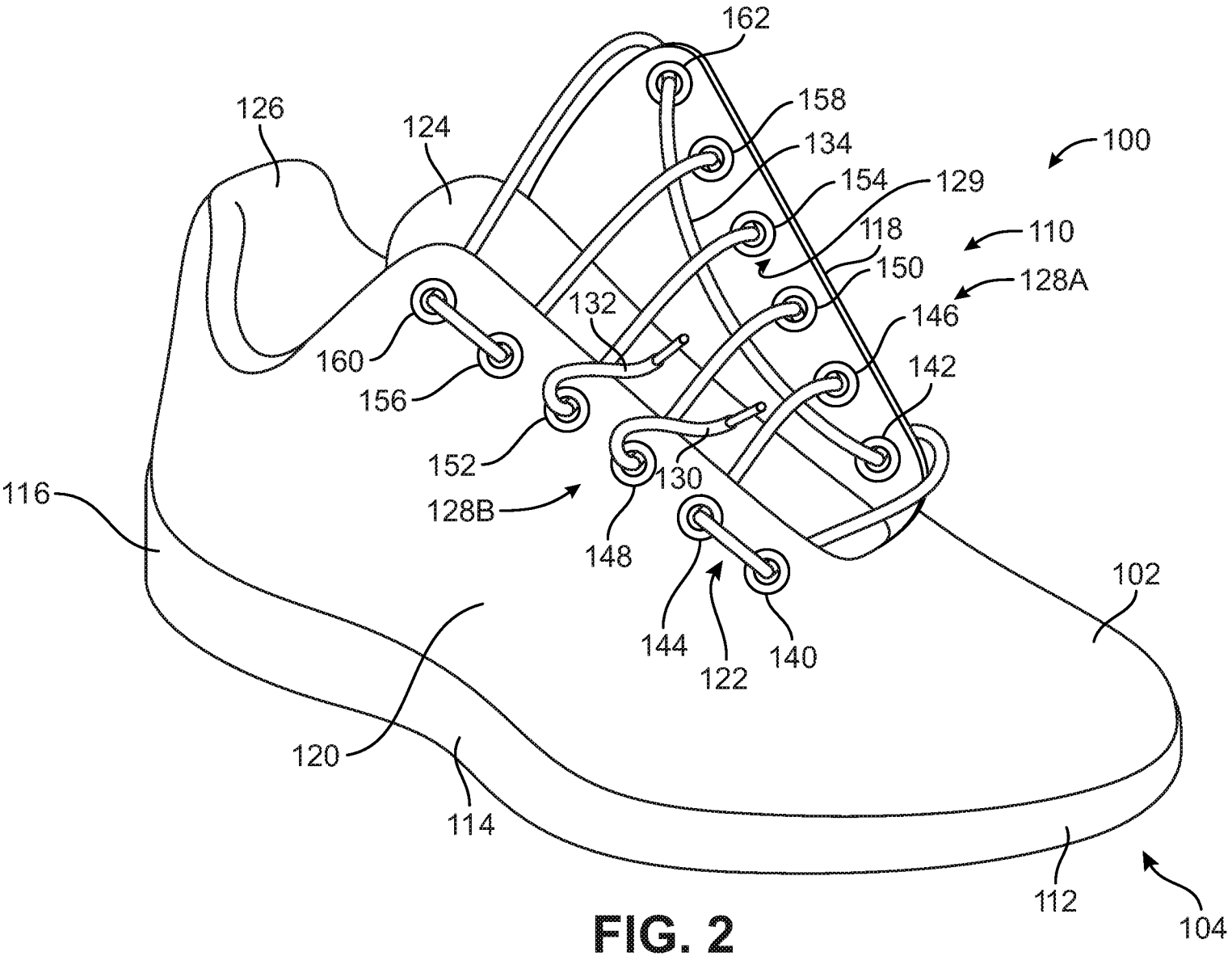
FIG. 2 is a lateral isometric view of the article of footwear of FIG. 1.
Figure 3:
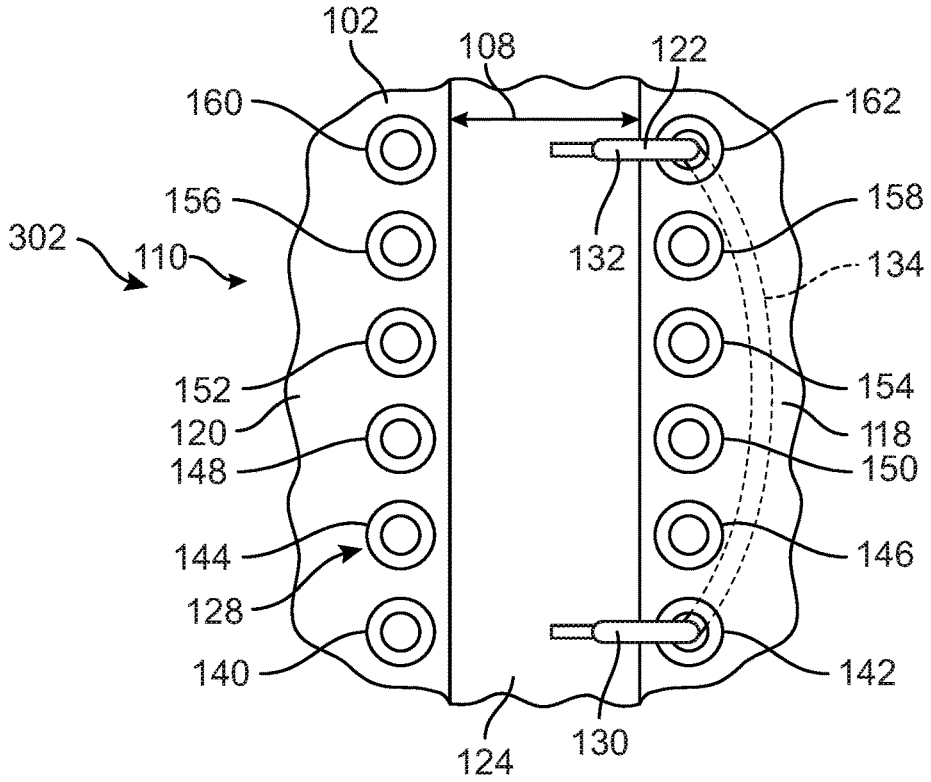
FIG. 3 is a schematic fragmentary plan view of the article of footwear of FIG. 1 including the lacing system during a lacing process.

FIGS. 1 and 2 illustrate an exemplary embodiment of an article of footwear 100 with a lacing system 110 having a side lacing pattern. FIG. 1 is an isometric view of an embodiment of the article of footwear from the medial side while FIG. 2 is an isometric view of the same embodiment from the lateral side. The article of footwear 100 may include upper 102 and sole structure 104 secured to a lower portion of the upper 102 (for example, with adhesive, stitching, thermal bonding, or other techniques). The upper 102 and sole structure 104 together define an internal cavity 103 between the upper and sole structure. Generally, upper 102 provides a covering for the foot that comfortably receives and securely positions the foot with respect to sole structure 104. Upper 102 may be made from any suitable material or pluralities of materials, including, but not limited to, for example, nylon, natural leather, synthetic leather, natural rubber, or synthetic rubber. In some cases, upper 102 may be made of any suitable knitted, woven, or non-woven material.

Generally, sole structure 104 is positioned between a foot of a wearer and the ground, and in different embodiments may incorporate various provisions. For example, as shown in FIGS. 1 and 2, sole structure 104 may include one or more of an inner sole component or insole, an outsole, a midsole, or a unitary combination of an outsole and midsole (i.e., a unisole). The insole may take the form of a sockliner adjacent the foot. It will be understood that in other embodiments, an insole may be optional. In addition, the outsole may be configured to contact a ground surface. The midsole may serve as a cushion and support for the foot.

The sole structure 104 may contact a ground surface and have various features to deal with the ground surface. Examples of ground surfaces include, but are not limited to, indoor ground surfaces such as wood and concrete floors, pavement, natural turf, synthetic turf, dirt, as well as other surfaces. In some cases, the lower portion may include provisions for traction, including, but not limited to, traction elements, studs, and/or cleats. In some embodiments, an outsole is secured to a lower surface of the midsole. It will be understood that in other embodiments, an outsole may be optional. For example, a midsole may be configured to contact a ground surface directly. Furthermore, in other embodiments, a midsole could be provided with various traction elements, studs, and/or cleats. In still other embodiments, portions of a midsole and portions of an outsole can both be configured to contact a ground surface.

The sole structure 104 may be made of a variety of any suitable materials for a variety of functions. In one embodiment, one or more components of a sole structure, such as a midsole component, may be formed from a polymer foam (e.g., a polyurethane or ethylvinylacetate foam) material that attenuates ground reaction forces (i.e., provides cushioning) during walking, running, and other ambulatory activities. In various embodiments, components of a sole structure may also include fluid-filled chambers, plates, moderators, or other elements that further attenuate forces, enhance stability, or influence the motions of the foot, for example. In some embodiments, the outsole is formed from a wear-resistant rubber material that is textured to impart traction.

In different embodiments, upper 102 may have a variety of different configurations. As shown in FIG. 1, upper 102 may include one or more material elements (for example, meshes, textiles, foam, leather, and synthetic leather), which may be joined to define an interior cavity 103 (also referred to as a foot-receiving cavity) configured to receive a foot of a wearer. The material elements may be selected and arranged to impart properties such as light weight, durability, air permeability, wear resistance, flexibility, and comfort. Upper 102 may define an opening 126 (i.e., an ankle opening) through which a foot of a wearer may be received into the interior cavity 103. In particular, upper 102 may have any design, shape, size, and/or color. For example, in the exemplary embodiment, the article is an athletic shoe and so therefore upper 102 may have a mid-top configuration that is shaped to provide high mobility for an ankle within opening 126. However, the upper could be configured as a high-top upper for basketball or other activities. In some embodiments, upper 102 may also include tongue 124 that provides cushioning and support across the instep of the foot. The upper may include, in some embodiments, a heel counter. The upper 102 may also include other features such as a heel pull tab.

The lacing system 110 is also referred to as a tensioning system or fastening system as it is configured to tighten the upper around a foot received in the foot-receiving cavity. The lacing system 110 includes a single lace 122 and lace-receiving passages 140, 142, 144, 146, 148, 150, 152, 154, 156, 158, 160, and 162 arranged in rows of two on the upper 102 at a fastening zone of the upper 102 generally over the instep. In the embodiment shown, the lace-receiving passages 128 are eyelets that extend through the body of the upper 102 from an outer surface 127 to an inner surface 129. The plurality of lace-receiving passages 128 include a first set of lace-receiving passages 128A in a first zone of the upper 102 (i.e., on the medial side 118), and a second set of lace-receiving passages 128B in a second zone of the upper 102 (i.e., on the lateral side 120). A lacing gap 108 between the medial side 118 and the lateral side 120 over the tongue 124 separates the first zone and the second zone.

The single lace 122 may be a continuous segment or multiple segments interconnected so that there are only two ends, first end 130, also referred to as lower end, and second end 132, also referred to as upper end. The lace 122 may comprise any type of lacing material known in the art. Examples of laces that may be used include cables or fibers having a low modulus of elasticity as well as a high tensile strength. Generally, a lace may comprise any material including, but not limited to, leather, cotton, jute, hemp, metals, or synthetic fibers. Additionally, a lace may be coated with a material to increase friction in order to keep the lace fastened. In some cases, a lace may include elastic portions. A lace is a continuous elongated element, and has only two ends, including a first end and a second end, and is continuous between its ends.

In different embodiments, the lace 122 may be formed from a continuous strip of material. In some embodiments, a lace may be made of various materials. Examples of various materials that could be used include, but are not limited to, natural leather, synthetic leather, textiles, polymer sheets or strips, as well as other types of natural or synthetic materials. In one embodiment, a lace may be made of a generally inelastic material that resists stretching. In some cases, the material may be a woven or knitted textile material. In other cases, the material may be a plastic or polymer material. In other embodiments, a lace may be made of an elastic material that is configured to stretch in one or more directions. Furthermore, a lace may comprise a single strand of material, or can comprise multiple strands of material. One example of a material for the lace is SPECTRA™, manufactured by Honeywell of Morris Township, NJ, although other kinds of extended chain, high-modulus polyethylene fiber materials can also be used as a lace.

In FIG. 1, the lace-receiving passages 128 are eyelets. The term "lace-receiving passage" or "eyelet" as used throughout this detailed description and in the claims refers to a structure configured to receive or engage with a lace in an article of footwear. For example, in some embodiments, an eyelet may be a small hole or perforation extending through the body of the upper 102. The body of the upper 102 is the one or more layers of material or materials that surround the foot-receiving cavity 103. In some cases, an eyelet or lace-receiving passage may be a hole that is reinforced with a material including, but not limited to, metal, cord, fabric, or leather. In other embodiments, an eyelet or lace-receiving passage may be an opening formed by a loop of material secured to a body of the upper, including, but not limited to, fabric, cord, leather, or metal. In other embodiments, an eyelet or lace-receiving passage may be a structure such as a post or hook extending from the body of the upper that forms a channel configured as a lace-receiving passage, or any other provisions known in the art for receiving and directing a lace.

Lace 122 comprises only two ends: lower end 130 and upper end 132. Intermediate region 134 of lace 122 is between lower end 130 of lace 122 and upper end 132 of lace 122. The intermediate region 134 generally refers to a portion of lace 122 approximately at the midpoint of the lace 122 along its length. The intermediate region 134 is disposed below upper 102 (i.e., under an inner surface 129 of upper 102), and extends directly between the top and bottom eyelets on the medial side 118, as shown in the embodiment of FIG. 1, i.e., between second eyelet 142 and twelfth eyelet 162 discussed below. In further embodiments, lace 122 may be replaced with an elastic element. Additionally, while in the exemplary embodiment of FIG. 1 and FIG. 2, lace 122 is shown slack in intermediate region 134 for ease of viewing, some or all portions of the intermediate region 134 will be taut when the lace 122 is tightened. In still further embodiments, lace 122 may form a continuous loop with lower end 130 and upper end 132 being joined such as by fusing the ends or using a clip to connect both ends. In still other embodiments, the lace 122 may combine an elastic and/or tensile element with a continuous loop and/or multiple lacing segments. In still further embodiments, the lace 122 may comprise multiple laces or multiple lacing segments with one or more ends fixed to the upper.

In differing embodiments, the plurality of eyelets may have differing configurations. In the exemplary embodiment of FIG. 1 and FIG. 2, plurality of eyelets 128 comprises twelve individual eyelets in six rows of two, the rows parallel to one another, and each row oriented perpendicular to a longitudinal midline of upper 102. The rows of lace-receiving passages 128 include a first row comprising first eyelet 140 and second eyelet 142; a second row comprising third eyelet 144 and fourth eyelet 146; a third row comprising fifth eyelet 148 and sixth eyelet 150; a fourth row comprising seventh eyelet 152 and eighth eyelet 154; a fifth row comprising ninth eyelet 156 and tenth eyelet 158; and a sixth row comprising eleventh eyelet 160 and twelfth eyelet 162. The first row comprising first eyelet 140 and second eyelet 142 may also be known as the first end row or the bottom row. The sixth row comprising eleventh eyelet 160 and twelfth eyelet 162 may also be known as the second end row or the top row, and is nearer the ankle opening 126 than is the first end row. The second, third, fourth, and fifth rows comprise a set of intermediate rows. The intermediate rows are disposed between the top row and bottom row. Specifically, fifth eyelet 148 and sixth eyelet 150 comprise a first intermediate row; seventh eyelet 152 and eighth eyelet 154 comprise a second intermediate row; third eyelet 144 and fourth eyelet 146 comprise a third intermediate row; and ninth eyelet 156 and tenth eyelet 158 comprise a fourth intermediate row. In additional embodiments, the number of eyelet rows through which the lace 122 is routed may vary, as discussed with respect to FIGS. 13-15.

In the exemplary lacing pattern of FIG. 1 and FIG. 2, lace 122 makes an approximately 90-degree or right-angle turn at each eyelet, except the lace 122 may or may not make an approximately 90-degree turn at the eyelets 148, 152 from which the first and second ends 130, 132 extend, depending on how the ends 130, 132 are secured. This arrangement results in a lace configuration where segments of lace 122 traveling between two eyelets are orientated in either a first direction oriented from the toe toward the ankle, also known as between rows of eyelets, or in a second direction across a lacing gap 108, or within rows of eyelets (and perpendicular to the first direction). More specifically, from each of the lace-receiving passages except the lace-receiving passages 148, 152 from which the first end 130 and the second end 132 respectively exit, the lace 122 extends directly to one of the lace-receiving passages on a same one of the first portion (medial side 118) or the second portion (lateral side 120) and directly to one of the lace-receiving passages in the same row. Because the rows are all parallel with one another, the lace-receiving passages 142, 146, 150, 154, 158, and 162 on the medial side 118 are aligned with one another in a straight line, and the lace-receiving passages 140, 144, 148, 152, 156, and 160 on the lateral side 120 are aligned with one another in a straight line, the lace 122 turns approximately 90 degrees at each of the lace-receiving passages from which the lace extends directly to one of the lace-receiving passages on a same one of the medial side 118 or the lateral side 120, and directly to one of the lace-receiving passages in the same row (i.e., to the only other lace-receiving passage in the row in the embodiment shown, as each row has only two lace-receiving passages through which the lace 122 is routed).

In different embodiments, lacing gap 108 may be disposed in various locations on upper 102. In some embodiments, lacing gap 108 may be disposed between medial side 118 and lateral side 120 of upper 102. In other embodiments, lacing gap 108 may be disposed asymmetrically so that a portion of lacing gap 108 is disposed closer to medial side 118 or lateral side 120 of upper 102. The lacing gap 108 may be disposed in the front, in the rear, on the medial side, or on the lateral side of the upper 102.

As shown in FIG. 1 and FIG. 2, beginning at lower end 130 of lace 122, lower end 130 exits out of fifth eyelet 148 on medial side 118. From fifth eyelet 148, lace 122 continues over tongue 124 and upper 102 to sixth eyelet 150, where it then turns approximately 90 degrees and passes over upper 102 (i.e., outward of an outer surface 127 of upper 102) to fourth eyelet 146 in the second row of eyelets. Lace 122 then turns approximately 90 degrees and continues under upper 102, over tongue 124, under upper 102 to third eyelet 144. Lace 122 then exits out third eyelet 144, turning approximately 90 degrees, and continuing over upper 102 to first eyelet 140. Here, lace 122 then turns approximately 90 degrees and continues through first eyelet 140, under upper 102, over tongue 124, and over upper 102 to second eyelet 142, where intermediate region 134 of lace 122 turns approximately 90 degrees before it travels below upper 102 on medial side 118 from second eyelet 142 directly to twelfth eyelet 162 without passing through any eyelets therebetween. As used herein, a lace extends directly from one eyelet to another eyelet when the lace does not pass through any eyelet, other type of lace-receiving passage, or other structure than restrains the segment of the lace extending between the two eyelets. At twelfth eyelet 162, lace 122 then turns approximately 90 degrees and exits twelfth eyelet 162 and travels over upper 102 and tongue 124 to eleventh eyelet 160, passing under upper 102. At eleventh eyelet 160, lace 122 goes through the eyelet 160 and out and over upper 102 to make an approximately 90-degree turn before entering ninth eyelet 156. At ninth eyelet 156, lace 122 continues under upper 102, over tongue 124, under upper 102, to exit tenth eyelet 158, where it makes another approximately 90-degree turn before crossing upper 102 and again turning approximately 90 degrees to enter eighth eyelet 154. Lace 122 continues from eighth eyelet 154 under upper 102, over tongue 124, and under upper 102 to seventh eyelet 152, where upper end 132 exits the lacing pattern on lateral side 120, completing the lacing pattern on the lateral side 120. In differing embodiments, the degree of turn, the travel of the lace 122, and the exiting patterns may all vary.

In differing embodiments, the lace 122 may use differing lacing patterns with differing exiting locations. In the exemplary embodiment of FIG. 1 and FIG. 2, lace 122 has both upper end 132 and lower end 130 exit the lacing pattern in the middle intermediate eyelet rows (i.e., the first intermediate row and the second intermediate row) on the lateral side 120. Specifically, in FIG. 1 lace 122 has lower end 130 exit the plurality of eyelets 128 at fifth eyelet 148, while the upper end 132 exits the plurality of eyelets 128 at the seventh eyelet 152. Both upper end 132 and lower end 130 of lace 122 end on lateral side 120 of upper 102. In additional embodiments, the lace ends may exit from the medial side, such as by mirror flipping the lacing pattern over the longitudinal midline of the article of footwear 100. In further embodiments, each end may exit from a different side, with one end exiting on the medial side and one end exiting on the lateral side; for example, an embodiment with an odd number of eyelet rows may have lower end 130 end on medial side and upper end 132 end on lateral sides 120, or vice versa.

In differing embodiments, the lace 122 may exit the lacing pattern from eyelets at other rows. In the embodiment of FIG. 1 and FIG. 2, lace 122 has lower end 130 exit plurality of eyelets 128 at fifth eyelet 148, while the upper end 132 exit plurality of eyelets 128 at seventh eyelet 152. In a further embodiment, lower end 130 exits the second row at fourth eyelet 146 and upper end 132 exits the third row at sixth eyelet 150. Alternatively, lower end 130 may exit the fourth row at eighth eyelet 154 and upper end 132 may exit the fifth row at tenth eyelet 158. In even further embodiments, the lace ends may exit at the top or bottom rows. In a bottom-exiting configuration, lace 122 may have lower end 130 exit at first eyelet 140 while upper end 132 exits at third eyelet 144. In a top-exiting configuration, lace 122 may have lower end 130 exit at ninth eyelet 156 while upper end 132 may exit at eleventh eyelet 160.

In differing embodiments, the lacing system may be configured so that the lace 122 makes a different angle of turn at the eyelets. In the exemplary embodiment of FIG. 1 and FIG. 2, lace 122 has an approximately 90-degree turn at each eyelet except perhaps at the eyelets 148, 152 from which the first and second ends 130, 132 extend, depending on how the ends are ultimately secured relative to one another when the lace 122 is tensioned. Effectively, lace 122 has a perpendicular turn at every eyelet of plurality of eyelets 128 except for the exit at fifth eyelet 148 for lower end 130 and the exit at seventh eyelet 152 for upper end 132. In another embodiment, the lacing pattern may skip a single row or multiple rows of eyelets. In an additional embodiment, the lacing pattern may skip a single row or multiple rows of eyelets and use an approximately 90-degree turn between the active rows of eyelets. In still other embodiments, additional turn angles may be used, such as, but not limited to, approximately 270-degree turns, approximately 180-degree turns, approximately 360-degree turns, etc. In yet further embodiments, the lacing may use a combination of varying turn angles.

A 90-degree turn at an eyelet helps reduce the contact area between the lace 122 and the eyelet, thus reducing friction, especially compared with lacing patterns in which a lace crisscrosses over itself in the lacing gap 108 to extend directly between different rows of eyelets across the lacing gap 108. Further, by reducing friction at each turn, the lace may transfer the pull to additional rows. A common lacing issue is the inability to tighten the lace and therefore the upper at all rows of eyelets by pulling both ends of a lace, thereby requiring tightening of the lace in stages (i.e., by pulling on portions of the lace between the ends at different locations prior to pulling on the ends. However, with the lacing patterns shown and described herein, by reducing the friction at each eyelet, the lace 122 may be tightened at more pairs of eyelets via a single pull at the ends 130, 132 of the lace 122. Furthermore, the reduction in friction reduces the wear on the lace and increases the lifetime of the lace.

Additionally, intermediate side lacing, as demonstrated in differing embodiments, may be used in combination with 90-degree turns. As used herein, "intermediate side lacing" refers to a lacing pattern in which both ends of the lace exit on the same side of the lacing gap (i.e., both on the first portion (medial side 118) or both on the second portion (lateral side 120) of the article) and from the middlemost and adjacent rows, which in this embodiment are the first intermediate row (eyelets 148, 150) and the second intermediate row (eyelets 152, 154). Intermediate side lacing further enhances the degree to which tension can be evenly distributed over the article of footwear 100 by the lace 122. In contrast, a crisscross lacing pattern (where the lace crosses over itself), pulling the upper 102 tight at the top row and the bottom row of eyelets requires the pull to transfer via every row of eyelets. By using a side lacing pattern, as demonstrated by the exemplary embodiment of FIG. 1 and FIG. 2, the lace 122 need only travel half the number of rows of eyelets between each end 130, 132 and the bottom row or top row, respectively. This reduces the total number of turns by 20 percent in an embodiment having six rows as compared to a traditional crisscross lacing pattern in which the lace crisscrosses its way up from the bottom row to the top row with both ends exiting at eyelets in the top row. When intermediate side lacing is combined with using 90-degree turns between eyelets as described herein, the lace encounters less friction and fewer rows of eyelets from an end to the top row (from second end 132 to eyelets 160, 162) or bottom row (from first end 130 to eyelets 140, 142) when pulled. Thus, the 90-degree turns with intermediate side lacing allows a single pull at ends 130, 132 of the lace 122 to tighten the upper 102 at more rows more efficiently.

In differing embodiments, the lace 122 may travel using different methods. In the exemplary embodiment of FIG. 1 and FIG. 2, the intermediate region 134 of lace 122 travels under upper 102 between the top and bottom rows of eyelets on medial side 118 (i.e., between second eyelet 142 and twelfth eyelet 162). In other embodiments, the intermediate region 134 may be above the upper 102. Additionally, in the exemplary embodiment of FIG. 1 and FIG. 2, intermediate region 134 of lace 122 is on medial side 118. In further embodiments, intermediate region 134 of lace 122 may be on lateral side 120, for example by flipping the lacing pattern relative to the longitudinal midline of the article of footwear 100 in a mirror image of that shown. In even further embodiments, portions of the intermediate region 134 may cross between the lateral side 120 and the medial side 118.

The lacing pattern with the intermediate region 134 traveling between the top row and bottom row of eyelets allows for a single lace 122 to be used for the entire lacing pattern, while maintaining 90-degree turns of the lace 122 as described and intermediate side lacing. Additionally, the intermediate region 134 disposed as shown redistributes force between the top row and bottom row of eyelets, to effectively tighten at the top row via force at second end 132 or at the bottom row via force at first end 130 depending on which force is greater. Furthermore, when combined with the intermediate side lacing and 90-degree turns, the resulting lacing pattern reduces the total number of turns 20 percent over traditional lacing patterns. Also, the intermediate region 134 traveling under the upper 102 avoids exposing the intermediate region 134 to weather and the environment, as well as prevents the mid portion from becoming snagged, thereby reducing wear of the intermediate region 134.

In differing embodiments, the lacing pattern may avoid overlap (e.g., crisscrossing contact or other contact) of the lace 122 on itself. In the exemplary embodiments of FIG. 1-6, lace 122 extends through each of the eyelets only once. In other embodiments, the lace 122 may extend through one or more of the eyelets multiple times. In the exemplary embodiment of FIG. 1-6, lace 122 further avoids overlapping on itself at any individual eyelet row, with the lace only potentially crossing itself where intermediate region 134 of lace 122 travels under upper 102 between second eyelet 142 and twelfth eyelet 162. In other embodiments, portions of intermediate region 134 may overlap or contact lace 122 at eyelets 146, 150, 154, 158 one or more times if intermediate region 134 travels over upper 102 between eyelets 142, 162. In additional embodiments, the lace may avoid crossing itself at all. In still further embodiments, the lace may cross itself at one or more locations.

In differing embodiments, the lacing pattern may use differing methods of traveling under and over the upper 102, tongue 124, and eyelets. In the exemplary embodiment of FIG. 1-6, lace 122 exits at lower end 130 and upper end 132 from the plurality of eyelets 128 by extending from under upper 102 through eyelets 148, 152 respectively and out over upper 102. Further, when extending between adjacent rows, the lace 122 is disposed and travels over upper 102. But when extending between eyelets in the same one of the intermediate rows, the lace 122 extends below upper 102 and over tongue 124, with the lace 122 exiting out of eyelet and over the upper 102 on both sides 118, 120. For example, in FIGS. 1-2, between third eyelet 144 and fourth eyelet 146, lace 122 is under upper 102 but above tongue 124 and enters each eyelet 144, 146 from under the upper 102, exiting the eyelets 144, 146 to extend over the upper 102 to travel to the next row of eyelets. In alternative embodiments, the lacing pattern may be flipped "inside out" relative to that shown in FIG. 1, so that the lace 122 travels above the upper 102 (i.e., outward of the outer surface of the upper) when extending directly between eyelets of the same row, and traveling under the upper 102 when traveling directly between eyelets of adjacent rows. Additionally, lace 122 may be disposed relative to upper 102 differently at the top and bottom rows than at the intermediate rows. For example, in the exemplary embodiment of FIG. 1 and FIG. 2, rather than traveling below the upper 102 where extending from first eyelet 140 to enter second eyelet 142 and where extending from eleventh eyelet 160 to enter twelfth eyelet 162, lace 122 enters second eyelet 142 and twelfth eyelet 162 from above the upper 102. This enables the intermediate region 134 of lace 122 to be disposed below upper 102. In further embodiments, the travel of lace 122 at top and bottom rows may match the pattern of the lace 122 at the rest of the rows so that the travel of the intermediate region 134 is above the upper 102. Additionally, in embodiments where the travel of the lace 122 relative to the upper 102 at the intermediate rows is flipped "inside out" relative to that shown in FIG. 1, with the intermediate portion 134 traveling over the upper 102, the travel of the lace 122 between the top and bottom rows may also be flipped inside out. In further embodiments, the intermediate portion 134 may remain disposed under the upper 102 as in FIG. 1.

The method of lacing may vary between embodiments. In the exemplary embodiment of FIG. 3-6, four series of steps are shown; series of steps 302, series of steps 304, series of steps 406, and series of steps 408, demonstrating a method of lacing occurring in that order. The overall length of lace 122 is not shown to scale or consistently throughout the drawings, but is shown only long enough for clarity. In series of steps 302 shown in FIG. 3, lower end 130 and upper end 132 begin the lacing process by starting with intermediate region 134 of lace 122 extending below upper 102 as in FIG. 1 and FIG. 2, and pulling lower end 130 through second eyelet 142 and upper end 132 through twelfth eyelet 162.

Figure 4:
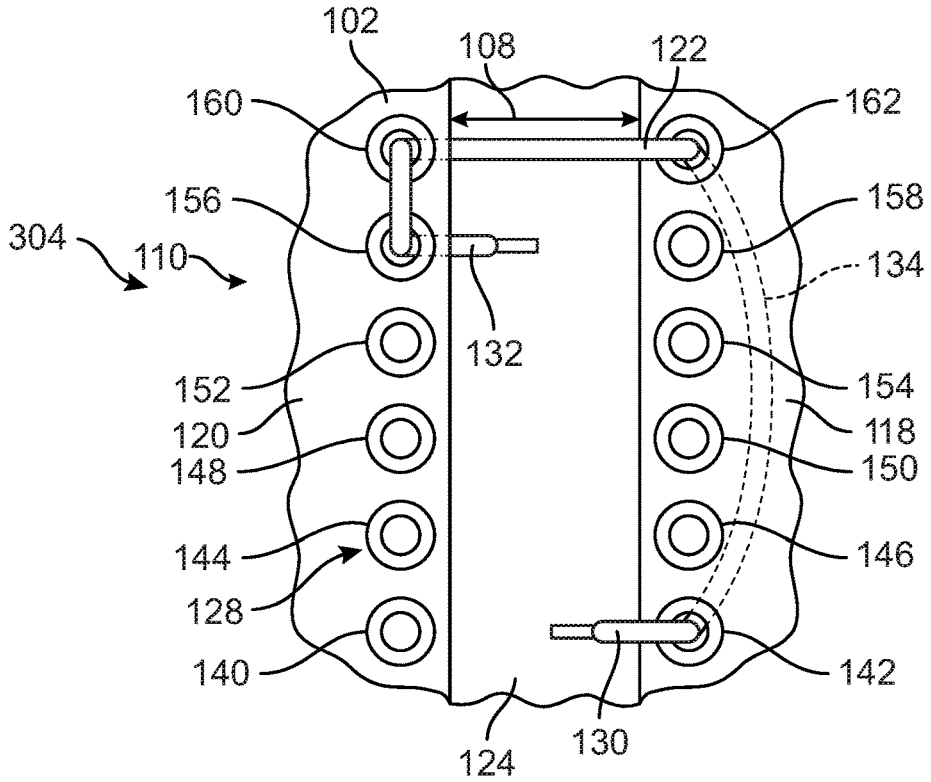
FIG. 4 is a schematic fragmentary plan view of the article of footwear of FIG. 1 including the lacing system during subsequent steps in the lacing process.

In series of steps 304 depicted in FIG. 4, upper end 132 is pulled over upper 102, across the gap 108, and under upper 102 to the underside of eleventh eyelet 160, and then out of the outside of eleventh eyelet 160, then turns approximately 90 degrees before traveling down to eyelet 156, through eyelet 156, turning again approximately 90 degrees, and traveling under the upper 102.

Figure 5:
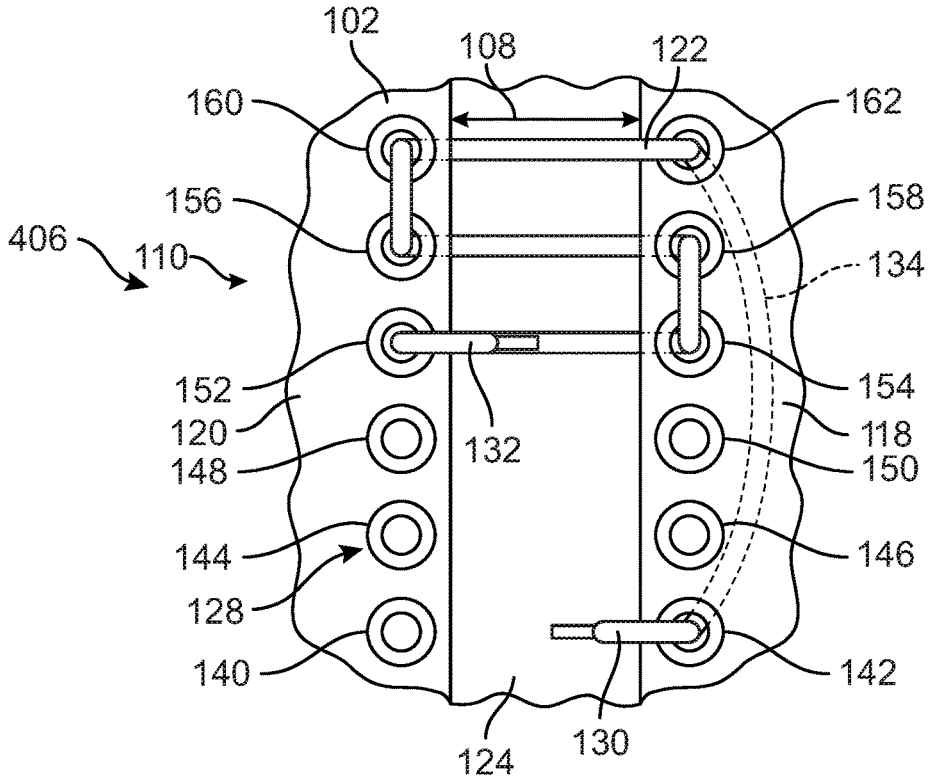
FIG. 5 is a schematic fragmentary plan view of the article of footwear of FIG. 1 including the lacing system during subsequent steps in the lacing process.
Figure 6:
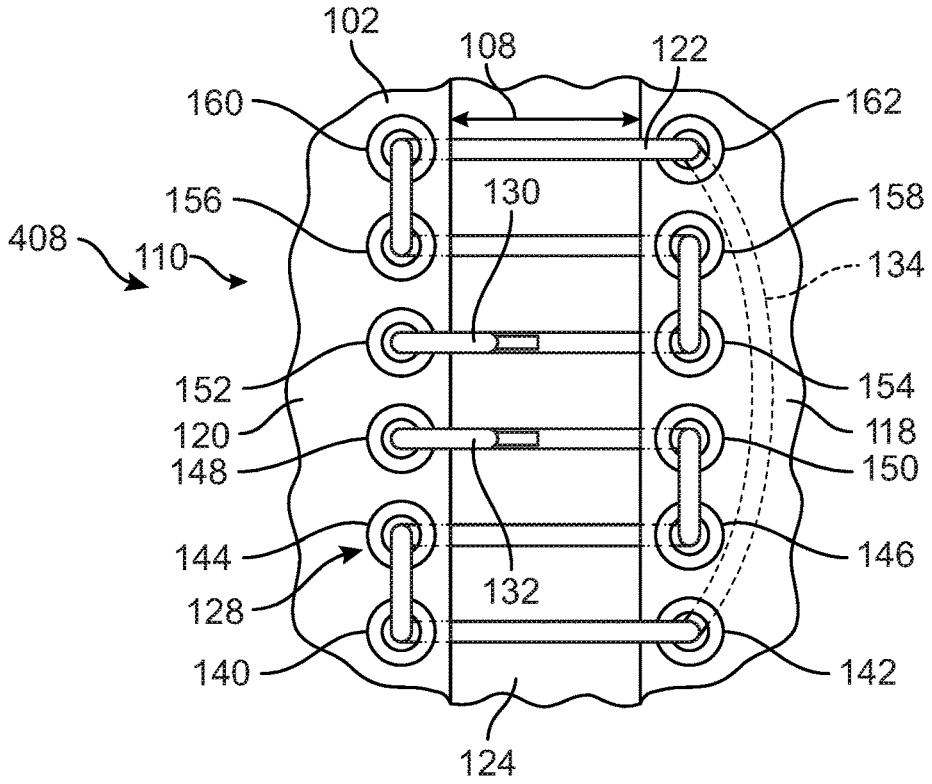
FIG. 6 is a schematic fragmentary plan view of the article of footwear of FIG. 1 including the lacing system during subsequent steps in the lacing process.

In series of steps 406 depicted in FIG. 5, upper end 132 continues across the lacing gap 108 over the tongue 124 and under upper 102 to tenth eyelet 158, entering tenth eyelet 158 from below. Lace 122 then exits eyelet 158 and turns approximately 90 degrees and crosses above upper 102 down to the eyelet 154, entering the eighth eyelet 154 from above, turns approximately 90 degrees again, and travels under upper 102, over tongue 124, then under upper 102 again and through seventh eyelet 152 such that upper end 132 exits at lateral side 120.

In series of steps 408, lower end 130 performs a mirror image of the same threading as upper end 132 does in step 302, step 304, and step 406. Lower end 130 starts at second eyelet 142 before moving across to first eyelet 140 by extending first over upper 102, over tongue 124, under upper 102, entering first eyelet 140 from underneath. Lower end 130 then exits first eyelet and turns approximately 90 degrees and threads over upper 102 to third eyelet 144, entering from above and extending through eyelet 144, underneath upper 102, turning approximately 90 degrees. Lower end 130 then crosses over to fourth eyelet 146 by extending first under upper 102 over tongue 124, under upper 102, then enters fourth eyelet 146 from underneath before exiting on the outside of fourth eyelet 146. Lower end 130 then turns approximately 90 degrees and extends over the upper 102 to sixth eyelet 150, entering sixth eyelet 150 from above and turning approximately 90 degrees before crossing from sixth eyelet 150 to fifth eyelet 148 by first extending under upper 102, over tongue 124, under upper 102, then entering fifth eyelet 148 from underneath, then exiting out of fifth eyelet 148 at the lateral side 120. In other embodiments, the lacing process may begin at any point in the lacing pattern between lower end 130 and upper end 132, with the ends tracing the lacing pattern. In further embodiments, the lacing process may be combined with any other variant in the lacing pattern, such as mirror flipping the lacing pattern of FIG. 1 over the longitudinal midline of the article of footwear 100, or flipping the lacing pattern inside out (i.e., reversing the position of the lace 122 outward of or inward of the upper 102).

Figure 7:
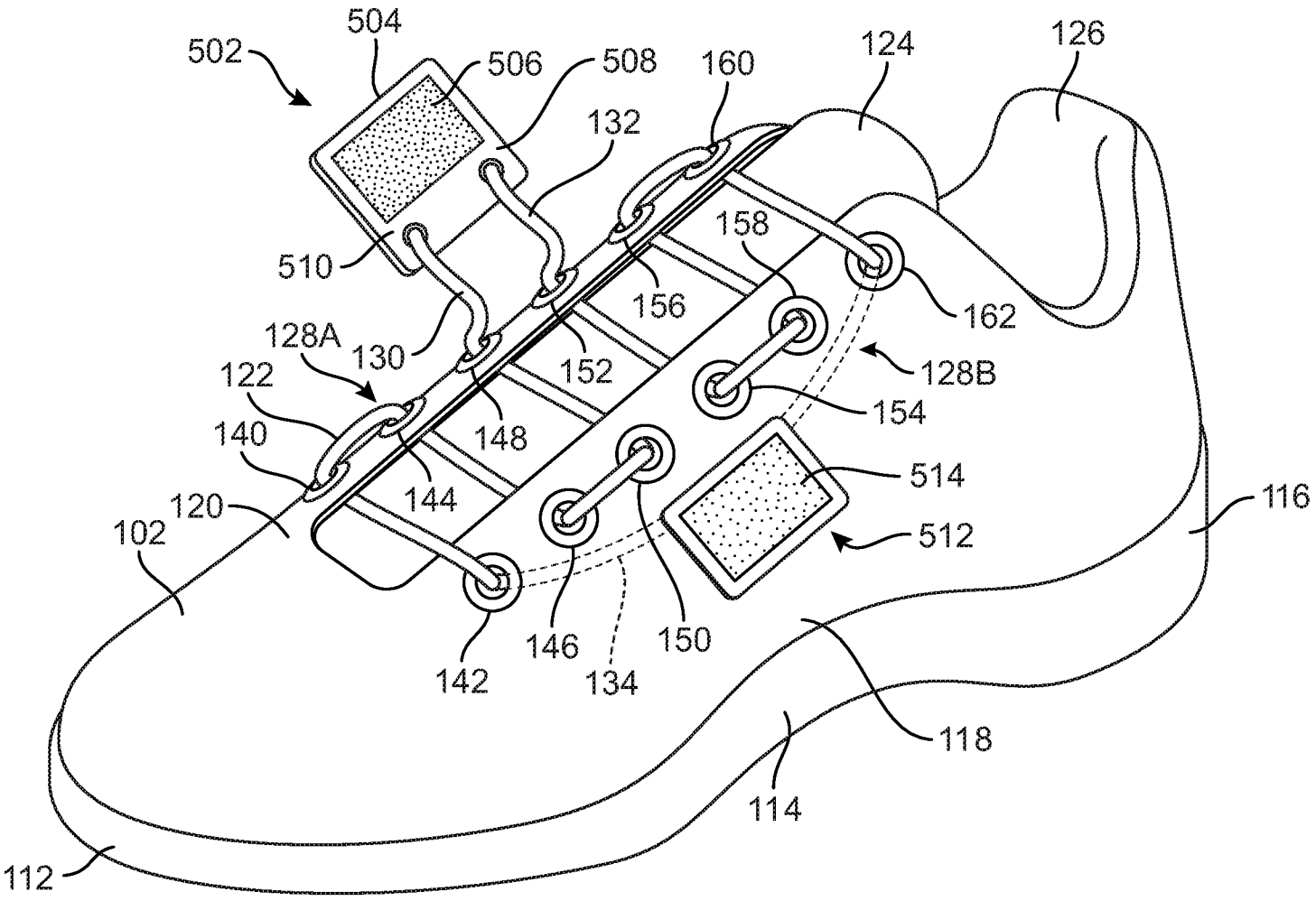
FIG. 7 is a medial isometric view of an embodiment of an article of footwear including an alternative lacing system with fasteners.

In various embodiments, any one or more of a variety of fasteners may be secured near the ends 130, 132 of the lace 122 to secure the lacing system. In the exemplary embodiment of FIG. 7, fastener 502 is a "hook-and-loop" fastener, such as a VELCRO® fastener, and secures both lower end 130 and upper end 132 of lace 122. Specifically, fastener 502 includes fastener body 504 and fastener base 512. Fastener body 504 comprises first hook-and-loop side 506, first fastener eyelet 508 and second fastener eyelet 510 receiving upper end 132 and lower end 130 of lace 122, respectively. Fastener base 512 is secured to the upper 102 at medial side 118, and has an opposing second hook-and-loop side 514. The ends 130, 132 can each be tied in a knot after extending through fastener body 504, or a lace anchor can be placed at each end 130, 132 to prevent the ends from passing back out of the fastener body 504. In some embodiments, first hook-and-loop side 506 comprises a hook side and second hook-and-loop side 514 comprises a loop side. In other embodiments first hook-and-loop side 506 comprises a loop side and second hook-and-loop side 514 comprises a hook side. Additionally, in some embodiments, lower end 130 and upper end 132 of lace 122 may attach to hook-and-loop fastener body 504 directly, such as by tying around fastener body 504 in a knot, by stitching or by heat bonding. Alternatively, in other embodiments, lower end 130 and upper end 132 of lace 122 may attach to each other, such as by tying a knot, stitching or heat bonding. Moreover, in the illustrated embodiment of FIG. 7, the fastener 502 tightens lace 122 while being fastened, and fastens by pulling fastener body 504 first across from lateral side 120 and pressing first hook-and-loop side 506 to second hook-and-loop side 514 on medial side 118. Also, as in the embodiment illustrated in FIG. 1, intermediate region 134 of lace 122 travels under upper 102. Accordingly, during the fastening process, fastener 502 avoids contacting or snagging the intermediate region 134 of lace 122. In other embodiments in which the lacing pattern is mirror flipped over the longitudinal midline of the footwear 100, the fastener base 512 will be on the lateral side 120, and the fastener body 504 will be pulled from the medial side 118 to the lateral side 120. Additionally, in the embodiment of FIG. 7, first hook-and-loop side 506 and second hook-and-loop side 514 are aligned with the same rows of eyelets. In further embodiments, the alignment of first and second hook-and-loop sides may vary. In some embodiments, the second hook-and-loop side 514 might be positioned on the upper 102 such that it is aligned with eyelets further up the article of footwear 100, such as tenth eyelet 158 and/or twelfth eyelet 162, or alternatively the second hook-and-loop side 514 might be aligned with eyelets further down the article of footwear 100 such as fourth eyelet 146 and/or second eyelet 142. In some embodiments, the first hook-and-loop side 506 might be aligned with eyelets further up the article of footwear 100, such as ninth eyelet 156 and/or eleventh eyelet 160, or alternatively the first hook-and-loop side 506 might be aligned with eyelets further down the article of footwear 100 such as third eyelet 144 and/or first eyelet 140.

Figure 8:
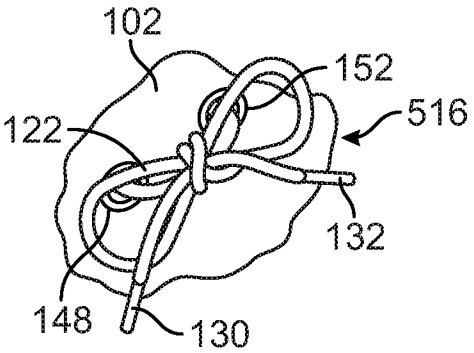
FIG. 8 is a schematic fragmentary plan view of the article of footwear of FIG. 1 with ends of the laces tied together.

Furthermore, FIGS. 8-12 illustrate various alternative fasteners that can be used in place of "hook and loop" fastener 502. These fasteners may be used individually or combined with any other method known in the art. Alternative fasteners illustrated include simply knotting both ends together, for example into bow 516 as shown in FIG. 8. Such a knot allows for the wearer to control the length of lace portions of lace 122 protruding from the eyelets 148, 152, allowing for more length of the lace 122 to extend than with the fastener body 504.

Figure 9:
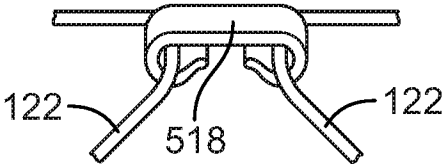
FIG. 9 is a schematic fragmentary isometric view of an alternative embodiment of a fastener securing the lace of the lacing system of FIG. 1.

In further embodiments, a clasp hook 518 shown in FIG. 9 may be used to hook portions of the lace 122 that are at opposing sides 118, 120. For example, a clasp hook 518 attached in this manner to portion of lace 122 disposed at opposite sides of the longitudinal midline helps avoid over-tightening of the lace 122.

Figure 10:
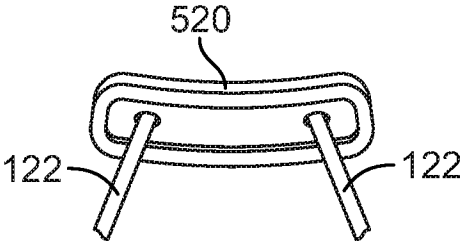
FIG. 10 is a schematic fragmentary isometric view of an alternative embodiment of a fastener securing the lace of the lacing system of FIG. 1.
Figure 11:
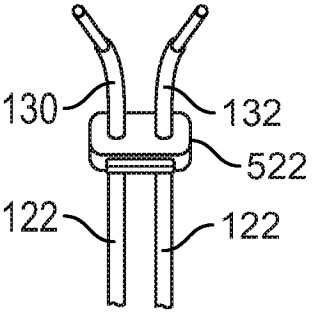
FIG. 11 is a schematic fragmentary isometric view of an alternative embodiment of a fastener securing the lace of the lacing system of FIG. 1.
Figure 12:
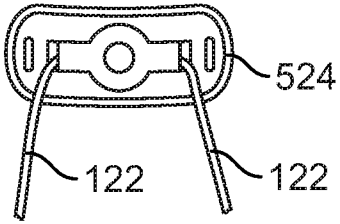
FIG. 12 is a schematic fragmentary isometric view of an alternative embodiment of a fastener securing the lace of the lacing system of FIG. 1.

In additional embodiments, a pull tab 520 shown in FIG. 10 may pull lace 122 tight when slid along the lace to act as the fastener. In other embodiments, a slip lock 522 shown in FIG. 11 may be used to tighten the laces. In yet another embodiment, slip lock buckle 524 shown in FIG. 12 may be used to lock and hold lace 122 in place. Furthermore, in additional embodiments, any suitable additional fasteners known in the art may be used alone or in combination with the listed fasteners. Embodiments can use any of the buckles or other fastening mechanisms or components disclosed in commonly owned U.S. Patent Application Publication No. 20170202313, to Spanks, or in commonly owned U.S. Patent Application Publication No. 20170202310 to Spanks et al., the entirety of both applications being herein incorporated by reference. Similarly, the laces described in either of these applications can also be understood to be available for use in the present disclosure.

Figure 13:
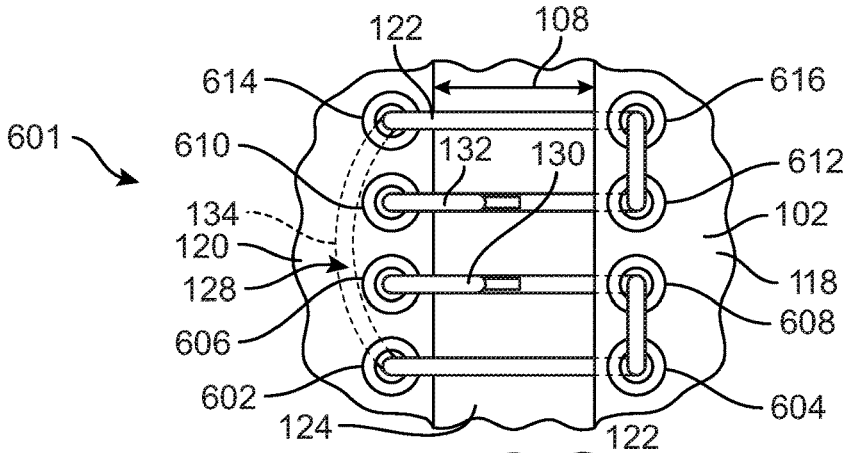
FIG. 13 is a schematic view of an article of footwear having an alternative lacing system with the lacing pattern of the lacing system of FIG. 1.
Figure 14:
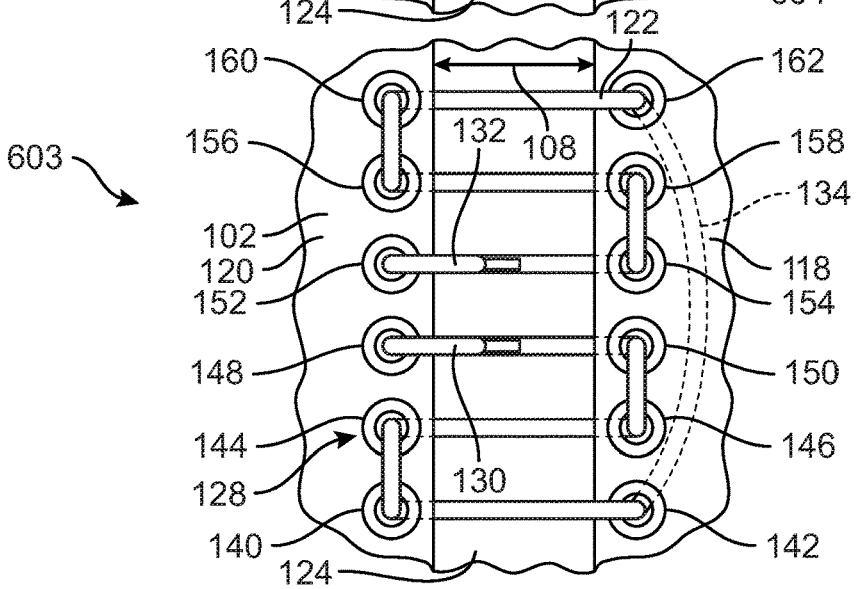
FIG. 14 is a schematic view of an article of footwear having an alternative lacing system with the lacing pattern of the lacing system of FIG. 1.
Figure 15:
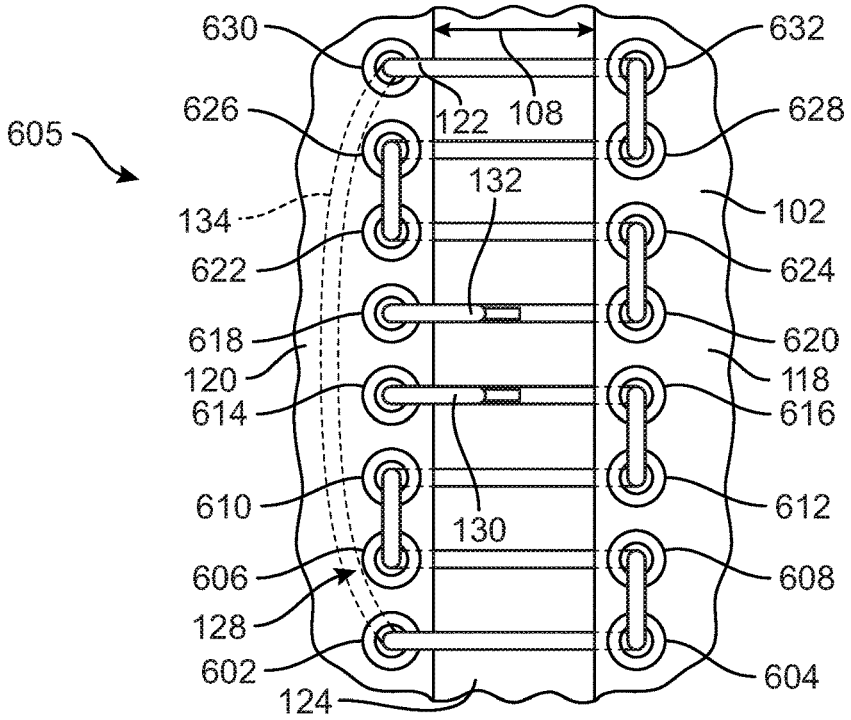
FIG. 15 is a schematic view of an article of footwear having an alternative lacing system with the lacing pattern of the lacing system of FIG. 1.

In differing embodiments, the number of the rows of eyelets may vary. FIGS. 13-15 show three different variants demonstrating the changes required for differing numbers of rows. FIGS. 13-15 illustrate that an increase in the number of eyelets while still providing a lacing pattern in which the ends 130, 132 exit from adjacent eyelets on the same side of the upper 102 and with the intermediate region 134 as described requires adding a new row at the top and bottom (i.e., two new rows), and switching the intermediate region from the medial side to the lateral side or vice versa. Schematic 601, schematic 603, and schematic 605 demonstrate this with four, six, and eight rows, although further embodiments can be extrapolated. Furthermore, in some embodiments, a combination of these patterns may be used with any other known method of lacing.

In schematic 601 of FIG. 13, a four-row configuration uses eight eyelets; first eyelet 602, second eyelet 604, third eyelet 606, fourth eyelet 608, fifth eyelet 610, six eyelet 612, seventh eyelet 614, and eighth eyelet 616. Lace 122 has lower end 130 exiting out of third eyelet 606, with the remainder of lace 122 continuing under upper 102, across tongue 124, and under upper 102 to fourth eyelet 608, where lace 122 enters fourth eyelet 608 from below. Lace 122 continues on and exits fourth eyelet 608 and turns approximately 90 degrees before it travels above upper 102 to second eyelet 604. Lace 122 extends through second eyelet 604 and turns approximately 90 degrees before continuing under upper 102, across tongue 124, and over upper 102 to first eyelet 602. Lace 122 extends through first eyelet 602, and turns approximately 90 degrees (although shown with slack in FIG. 13 for clarity) and such that intermediate region 134 of lace 122 travels underneath upper 102 on lateral side 120 to seventh eyelet 614. The lace 122 extends out of seventh eyelet 614, turns again approximately 90 degrees and crosses over upper 102 and tongue 124, then under upper 102 to eighth eyelet 616, and exits out of eighth eyelet 616. Lace 122 then turns approximately 90 degrees and travels over upper 102 to sixth eyelet 612. The lace 122 extends through sixth eyelet 612, then turns approximately 90 degrees and continues under upper 102, over tongue 124, and under upper 102 to fifth eyelet 610, and extend through fifth eyelet 610 where upper end 132 exits the lacing pattern on lateral side 120. In other embodiments, the lacing pattern may vary by flipping the lacing pattern inside out relative to the upper, mirror flipping the pattern across the longitudinal midline of the article of footwear, and/or by any other variation discussed above.

In schematic 603 of FIG. 14, a six-row configuration using twelve eyelets is identical to that of FIG. 1-5. In other embodiments, the lacing pattern of the configuration with six rows of eyelets may vary by flipping the pattern inside out, mirror flipping the pattern across the median, and by any other variation discussed above. In schematic 605, an eight-row configuration using sixteen eyelets is demonstrated, using first eyelet 602, second eyelet 604, third eyelet 606, fourth eyelet 608, fifth eyelet 610, six eyelet 612, seventh eyelet 614, eighth eyelet 616, ninth eyelet 618, tenth eyelet 620, eleventh eyelet 622, twelfth eyelet 624, thirteenth eyelet 626, fourteenth eyelet 628, fifteenth eyelet 630, and sixteenth eyelet 632. Lace 122 has lower end 130 exiting out of seventh eyelet 614, with the remainder of the lace 122 continuing under upper 102, across tongue 124, and under upper 102 to where lace 122 enters eighth eyelet 616 from below. Lace 122 exits eighth eyelet 616 at the outer surface of upper 102 and turns approximately 90 degrees before continuing on over the upper 102 to sixth eyelet 612. At sixth eyelet 612, lace 122 enters through the eyelet and turns approximately 90 degrees before continuing under upper 102, over tongue 124, and under upper 102 to fifth eyelet 610. At fifth eyelet 610, lace 122 enters from the inside of upper 102, and exits out of eyelet 610 before turning approximately 90 degrees and continuing on over upper 102 to third eyelet 606. Lace 122 extends through third eyelet 606 and continues under upper 102, across tongue 124, and under upper 102 to fourth eyelet 608, where lace 122 enters fourth eyelet 608 from below. Lace 122 exits fourth eyelet 608 and turns approximately 90 degrees before it travels above upper 102 to second eyelet 604. Lace 122 extends through second eyelet 604 and turns approximately 90 degrees before continuing under upper 102, across tongue 124, and over upper 102 through first eyelet 602. At first eyelet 602, lace 122 turns approximately 90 degrees such that intermediate region 134 of lace 122 travels under upper 102 on lateral side 120 and exits through fifteenth eyelet 630. At fifteenth eyelet 630, the lace 122 turns again approximately 90 degrees and extends over upper 102, over tongue 124 and under upper 102 to sixteenth eyelet 632 and exiting outward through sixteenth eyelet 632. Lace 122 then turns approximately 90 degrees and travels over upper 102 to fourteenth eyelet 628. Lace extends through fourteenth eyelet 628, and then turns approximately 90 degrees and continues under upper 102, over tongue 124, under upper 102 to thirteenth eyelet 626. At thirteenth eyelet 626, lace 122 enters the eyelet 626 from below and exits above the eyelet 626, turning approximately 90 degrees before continuing over upper 102 down to eleventh eyelet 622. At eleventh eyelet 622, lace 122 enters the eyelet from above and turns approximately 90 degrees before continuing under upper 102, over tongue 124, and under upper 102 to twelfth eyelet 624. At twelfth eyelet 624, lace 122 enters from below and extends through the eyelet 624, turning approximately 90 degrees before continuing over upper 102 to tenth eyelet 620. At tenth eyelet 620, lace 122 extends through tenth eyelet 620 and turns approximately 90 degrees, continuing under upper 102, over tongue 124, and under upper 102 to ninth eyelet 618. At ninth eyelet 618, lace 122 enters from below and upper end 132 exits the eyelet 618 and is disposed at lateral side 120. In other embodiments, the lacing pattern may vary by flipping the pattern inside out, mirror flipping the pattern across the longitudinal midline, and by any other variation discussed above.

Additional patterns may be followed using the same basic formula illustrated with respect to the four row pattern in schematic 601, the six row pattern schematic 603, and the eight row pattern in schematic 605 by adding a row of eyelets to the top and bottom and continuing the same pattern of turning approximately 90 degrees when extending from an eyelet in one row to an eyelet in an adjacent row. Furthermore, an odd number of rows is possible if both ends of the lace share the same row, allowing for a middle lacing variant.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear comprising:

a body having an exterior, a longitudinal midline, a first portion, and a second portion opposite the first portion along the longitudinal midline;

a lacing system including a lace and lace-receiving passages arranged in rows on the body, each of the rows including a lace-receiving passage on the first portion and a lace-receiving passage on the second portion, and the rows including at least a first end row, a second end row, a first intermediate row, and a second intermediate row; wherein the first intermediate row and the second intermediate row are disposed between the first end row and the second end row and are adjacent to one another;

wherein the lace extends through each of the lace-receiving passages, a first end of the lace extends through and terminates from one of the lace-receiving passages in the first intermediate row, and a second end of the lace extends through and terminates from one of the lace-receiving passages in the second intermediate row;

wherein the lace extends directly from one of the lace-receiving passages of the first end row to one of the lace-receiving passages of the second end row on an opposite one of the first portion or the second portion than the lace-receiving passages from which the first end and the second end terminate;

wherein the lace is arranged in an asymmetric configuration across the longitudinal midline on the exterior such that the lace is routed in a different configuration on a medial side of the article of footwear than on a lateral side of the article of footwear; and wherein each of the lace-receiving passages of the first intermediate row and the second intermediate row are arranged in a symmetrical configuration across the longitudinal midline on the exterior.

2. The article of footwear of claim 1, wherein the lace extends under the body from said one of the lace-receiving passages in the first end row to said one of the lace-receiving passages in the second end row.

3. The article of footwear of claim 1, wherein from each of the lace-receiving passages except the lace-receiving passages from which the first end and the second end terminate, the lace extends directly to one of the lace-receiving passages on a same one of the first portion or the second portion and directly to one of the lace-receiving passages in a same one of the rows.

4. The article of footwear of claim 3, wherein the rows are parallel such that the lace turns approximately 90 degrees at each of the lace-receiving passages from which the lace extends directly to one of the lace-receiving passages on a same one of the first portion or the second portion and directly to one of the lace-receiving passages in a same one of the rows.

5. The article of footwear of claim 1, wherein the lace extends through each of the lace-receiving passages only once.

6. The article of footwear of claim 1, wherein the body is an upper of the article of footwear.

7. The article of footwear of claim 6, wherein the body defines an ankle opening, and the second end row is nearer the ankle opening than is the first end row.

8. The article of footwear of claim 1, wherein the first end is tied to the second end.

9. The article of footwear of claim 1, further comprising:

a fastener securing the first end and the second end of the lace relative to one another.

10. The article of footwear of claim 1, wherein the lace-receiving passages are eyelets extending through the body from an inner surface of the body to an outer surface of the body.

11. An article of footwear comprising:

an upper having an exterior, a longitudinal midline, a first portion, and a second portion opposite the first portion along the longitudinal midline;

a lacing system including a lace and lace-receiving passages arranged in rows on the upper, each row including a lace-receiving passage on the first portion, and a lace-receiving passage on the second portion;

wherein the rows include at least a top row, a first intermediate row, a second intermediate row, and a bottom row, wherein the first intermediate row and the second intermediate row are disposed between the top row and the bottom row;

wherein a first end of the lace extends through and terminates from one of the lace-receiving passages in the first intermediate row;

wherein a second end of the lace extends through and terminates from one of the lace-receiving passages in the second intermediate row;

wherein each portion of the lace extending directly between any two of the lace-receiving passages either travels between two of the lace-receiving passages that are in the same row or between two of the lace-receiving passages that are in adjacent ones of the rows and are on a same one of the first portion or the second portion of the upper;

wherein the lace extends directly between one of the lace-receiving passages in the top row and one of the lace-receiving passages in the bottom row on a same one of the first portion or the second portion of the upper;

wherein the lace is arranged in an asymmetric configuration across the longitudinal midline on the exterior such that the lace is routed in a different configuration on a medial side of the article of footwear than on a lateral side of the article of footwear; and wherein each of the lace-receiving passages of the first intermediate row and the second intermediate row are arranged in a symmetrical configuration across the longitudinal midline on the exterior.

12. The article of footwear of claim 11, wherein the lace is disposed over the upper where the lace extends directly between two of the lace-receiving passages that are in adjacent ones of the rows.

13. The article of footwear of claim 11, wherein the lace is disposed under the upper where the lace extends directly between two of the lace-receiving passages that are in a same one of the rows.

14. The article of footwear of claim 11, wherein the lace is disposed under the upper where the lace extends directly between two of the lace-receiving passages in non-adjacent ones of the rows.

15. The article of footwear of claim 11, wherein the lace extends through each of the lace-receiving passages only once.

16. The article of footwear of claim 11, wherein from each of the lace-receiving passages except those from which the first end and the second end terminate, the lace extends to one of the lace-receiving passages on a same one of the first portion or the second portion and to one of the lace-receiving passages in a same one of the rows.

17. The article of footwear of claim 11, wherein the first portion is the medial side of the upper, the second portion is the lateral side of the upper, the medial side and the lateral side are spaced apart by a gap; wherein the lace extends across the gap when extending between lace-receiving passages in a same one of the rows; and wherein the lace travels beneath the upper directly from one of the lace-receiving passages in the top row to one of the lace-receiving passages in the bottom row.

* * * * *